US007195467B2

(12) United States Patent
Cadeddu

(10) Patent No.: US 7,195,467 B2
(45) Date of Patent: Mar. 27, 2007

(54) INTERNAL GEAR MACHINE WITH VARIABLE CAPACITY

(75) Inventor: Leonardo Cadeddu, Crema (IT)

(73) Assignee: VHIT S.p.A., Crema (IT)

( * ) Notice: Subject to any disclaimer, the term of this patent is extended or adjusted under 35 U.S.C. 154(b) by 25 days.

(21) Appl. No.: 10/519,244

(22) PCT Filed: Jun. 17, 2003

(86) PCT No.: PCT/EP03/06413

§ 371 (c)(1),
(2), (4) Date: Dec. 27, 2004

(87) PCT Pub. No.: WO2004/003345

PCT Pub. Date: Jan. 8, 2004

(65) Prior Publication Data

US 2005/0254982 A1 Nov. 17, 2005

(30) Foreign Application Priority Data

Jun. 26, 2002 (IT) ..... TO2002A0551

(51) Int. Cl.
*F03C 2/00* (2006.01)
*F04C 2/00* (2006.01)

(52) U.S. Cl. ..... 418/21; 418/20; 418/28; 418/171

(58) Field of Classification Search ..... 418/20, 418/21, 28, 166, 171
See application file for complete search history.

(56) References Cited

U.S. PATENT DOCUMENTS 1,486,682 A 3/1924 Phillips
1,773,211 A * 8/1930 Wilsey ..... 418/9
2,484,789 A * 10/1949 Hill et al. ..... 418/21
3,687,578 A * 8/1972 White et al. ..... 418/21
4,740,142 A 4/1988 Rohs et al.

FOREIGN PATENT DOCUMENTS

DE 862094 * 1/1953 ..... 418/21
DE 2 243 208 3/1974
GB 859793 * 1/1961 ..... 418/21

OTHER PUBLICATIONS

Patent Abstracts of Japan vol. 005, No. 068 (M-067), May 8, 1981 & JP 56 020788 A (Fujita Minoru), Feb. 26, 1981 abstract.
Patent Abstracts of Japan vol. 001, No. 023 (M-011), Mar. 25, 1977 & JP 51 137903 A (Aisin Seiki Co Ltd), Nov. 29, 1976.

* cited by examiner

*Primary Examiner*—Theresa Trieu
(74) *Attorney, Agent, or Firm*—Young & Thompson

(57) ABSTRACT

A fluidic machine has a fixed body, an external orbital member rotatable around a first rotational axis and internal gear teeth including a first teeth number, a transmission member rotatable around a second rotational axis, an internal orbital member supported by the transmission member, having external gear teeth including a second teeth number different from the first teeth number and meshing with the internal gear teeth of the external orbital member, thus determining among the gear teeth of the two orbital members spaces whose volume is variable during rotation. One of the orbital members is mounted axially displaceable and is pushed by an elastic push member in the direction producing a more extended engagement with the other orbital member, and a piston, mounted displaceable within the non-axially displaceable orbital member and resting against the axially displaceable orbital member, is subjected, to the pressure of the high pressure connection.

13 Claims, 10 Drawing Sheets

INTERNAL GEAR MACHINE WITH VARIABLE CAPACITY

BACKGROUND OF THE INVENTION

The subject of the present invention is a fluidic machine whose swept volume is variable as a function of the pressure. The generic expression "fluidic machine" is to point out that the machine can be a pump, whose swept volume varies as a function of the outlet deliver pressure, or a motor, whose swept volume varies as a function of the inlet feed pressure. The invention is foreseen to be particularly applied to hydraulic machines, however it can be applied to pneumatic machines too.

DESCRIPTION OF THE RELATED ART

In several technical applications, for example in order to have the lubricant oil circulate under pressure in engines, particularly automotive engines, the so-called gear pumps are used, which in the types here taken into account comprise a fixed body, an external orbital member rotatable in said body around a first rotational axis, an internal orbital member rotatable inside said external orbital member around a second rotational axis not coincident with said first rotational axis, and a transmission member intended to impart the rotation to one of said orbital members, one of the members also having a distribution function with respect to the spaces included between the two orbital members and to two chambers provided in the body and communicating with an intake feed connection (low pressure connection) and with an outlet delivery connection (high pressure connection), respectively. Each orbital member has gear teeth which mesh, with a relative (namely, only partial) hydraulic seal, with the gear teeth of the other orbital member, and the teeth number is different for the two orbital members, whereby they are obliged to rotate in corresponding manner but with different angular speed and, among the respective teeth some spaces of variable volume are provided. By a suitable shaping of the distributor, this device acts as a pump. In the mentioned automotive application, this pump is driven by the vehicle engine, and therefore it rotates with a variable speed, like the driving engine.

In the known embodiments, these pumps have a constant geometry, and therefore their swept volume is fixed, and this means that for each turn the pumps deliver a fixed quantity of fluid, whereby their delivery rate varies as a function of the rotational speed of the engine and so of the pump itself. Because it is needed that a perfect lubrication of the engine is ensured at the lower rotational speeds too, the pump should be designed in such a way as to ensure a sufficient delivery rate when it is driven at a reduced rotational speed. As a consequence, when the pump is driven at a high rotational speed, it supplies a delivery rate larger than that required, and therefore it has the disadvantage of a unnecessary energy absorption from the engine and, finally, of an increase in the fuel consumption.

Similar problems are encountered in other applications, in which a structure of the described kind is used, in opposite manner, as a hydraulic motor; in this case, the high pressure connection is the feed connection and the low pressure connection is the exhaust connection. Moreover, problems similar to those of the hydraulic machines may be encountered in pneumatic pumps and motors too.

SUMMARY OF THE INVENTION

The main object of the present invention is to find a remedy for the disadvantages of the known fluidic machines of the gear type taken into account here, and more particularly to the variability of their performance as a function of the operation conditions. More specifically, with reference to the operation of such a machine as a pump, the invention aims to prevent or to reduce the variation of the pump delivery rate depending on the driving speed. Another object of the invention is to attain the stated purpose in a completely automatic way, without having recourse to any control member external to the machine itself. Still another object of the invention is to attain the stated objects in a way favorable from the points of View of the economy and of the reliability, and therefore without introducing in the machine complicated structures, suitable of causing an excessive increase of the cost thereof or of increasing the possibility of damages or wrong operations.

Therefore, the subject of the invention is a fluidic machine comprising: a fixed body; an external orbital member installed in said fixed body, supported and guided by said fixed body for rotation around a first rotational axis, said external orbital member having internal gear teeth comprising a first teeth number; a transmission member installed in said fixed body, supported and guided by said fixed body for rotation around a second rotational axis not coincident with said first rotational axis; an internal orbital member supported by said transmission member and solid in rotation therewith, said internal orbital member having external gear teeth comprising a second teeth number different from said first teeth number, and said internal orbital member extending within said external orbital member and having its own external gear teeth meshing, with relative fluid seal, with the internal gear teeth of the external orbital member, thus determining among the gear teeth of the two orbital members some spaces whose volume is variable during the rotation; said fixed body having two chambers, connected with a low pressure connection and to a high pressure connection, respectively, and one of said members being so shaped as to act as a distributor among said variable volume spaces and said chambers of the fixed body; characterized in that one of said orbital members is mounted axially displaceable, with relative fluid seal, in the component part by which it is supported; that the machine comprises a push member acting against said axially displaceable orbital member for pushing the same in the direction producing a more extended engagement with the other orbital member; and that the machine comprises a piston, which is mounted displaceable, with fluid seal, within the non-axially displaceable orbital member, rests against said axially displaceable orbital member, and is subjected, on the side opposite the axially displaceable orbital member, to the pressure of the high pressure connection; whereby said axially displaceable orbital member is pushed by the pressure of the high pressure connection to withdraw, against the action of said push means, within the part supporting the same, this latter along with said piston delimiting the operatively active portion of the two mutually meshing orbital members, namely, the swept volume of the fluidic machine.

In this way, until the force exerted onto said piston by the pressure of said high pressure connection remains lower than the force exerted by said push means onto said axially displaceable orbital member, this latter remains pushed by the push means in its position of more extended engagement with the other orbital member, and therefore it gives raise to a swept volume of the machine, that is the greatest possible.

When the force exerted onto said piston by the pressure of said high pressure connection overcomes the force exerted by said push means onto said axially displaceable orbital member, this latter is displaced by the piston towards positions of lesser engagement with the other orbital member, and therefore it gives raise to a reduced swept volume of the machine. By suitably choosing the characteristics of said push means with respect to the piston surface which is exposed to the pressure of said high pressure connection, it is possible to obtain a variation of the swept volume of the fluidic machine as a function of the pressure of the high pressure connection (and therefore the delivered pressure, if the machine is a pump, or the feed pressure, if the machine is a motor), that is considered the more favorable for preventing or limiting the performance variations of the machine when varies the speed with which the machine is actuated, if the machine is a pump, or varies the pressure with which it is fed, if the machine is a motor.

In particular, when the machine acts as the pump which circulates under pressure the lubricant oil of a vehicle engine, it is possible to obtain that the delivery rate of the pump, designed for being sufficient at a reduced speed, increases in a reduced way, or even of a negligible or null amount, when the operation speed increases. The arrangement of the invention may even allow, in those cases in which this appears to be desirable, to invert the sense of the delivery rate variation as a function of the pump speed, namely, obtaining a reduction of the delivered rate when the operation speed increases.

In a preferred embodiment, the external orbital member is mounted in a fixed axial position, and the internal orbital member is mounted axially displaceable, with relative fluid seal, within the transmission member having an internal outline corresponding to the external outline of the internal orbital member, which penetrates in part therein with relative fluid seal; and said push means comprise a compression spring acting between a surface of said internal orbital member and an end surface of a cavity of the transmission member, in which cavity is mounted the internal orbital member.

In another possible embodiment, on the contrary, the internal orbital member is mounted in a fixed axial position, and the external orbital member is mounted axially displaceable, with relative fluid seal, within said machine body; and said push means comprise a compression spring acting between a surface of said external orbital member and an end surface of a cavity of the machine body, in which cavity is mounted the external orbital member.

In a preferred embodiment, the external orbital member has internal gear teeth comprising five teeth, and the internal orbital member has external gear teeth comprising four teeth.

In a preferred embodiment, the machine body is formed of two mutually connected parts, a first part forming an operative body which contains the external orbital member, and a second part forming a supporting body which contains the transmission member, one of said parts comprising the low pressure and the high pressure connections.

Therefore, the low pressure and high pressure connections can be located in the body part forming a supporting body or in the body part forming an operative body.

Said member intended to act as a distributor may be said transmission member or said external orbital member.

BRIEF DESCRIPTION OF THE DRAWINGS

These and other features, objects and advantages of the subject of the present invention will more clearly appear from the following description of two not limiting examples of embodiments of the machine as a hydraulic pump, the description being drawn with reference to the accompanying drawings, wherein.

DESCRIPTION OF THE PREFERRED EMBODIMENT

Figure 1:
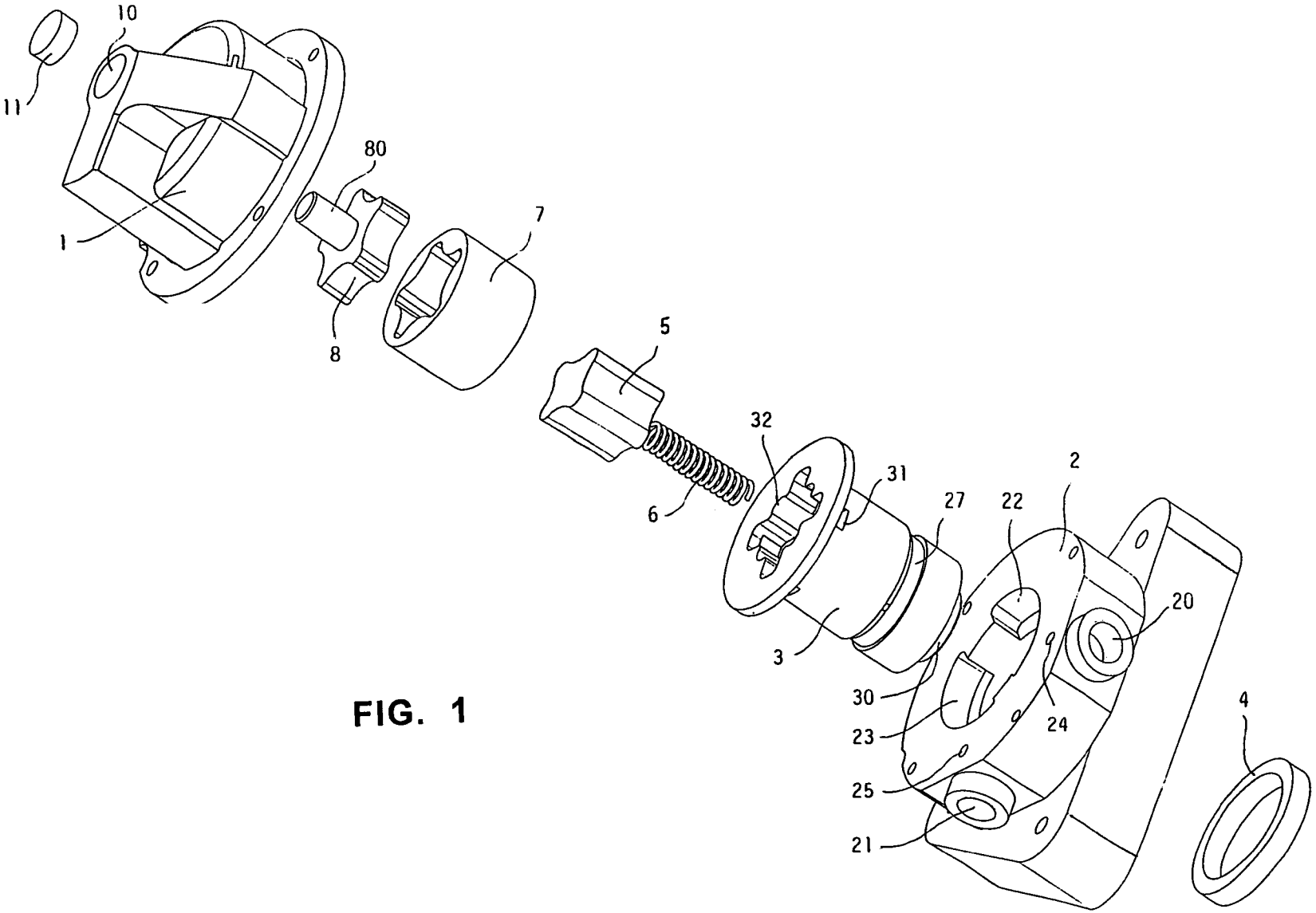
FIG. 1 illustrates the component parts of the fluidic machine in an exploded view in perspective representing the first embodiment described.
Figure 3:
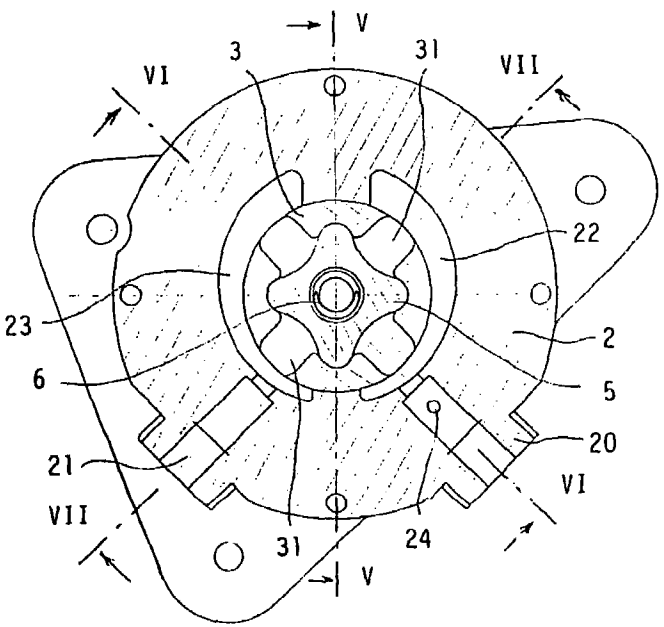
FIG. 3 shows a cross section of the machine, taken along line III—III of FIG. 2.
Figure 2:
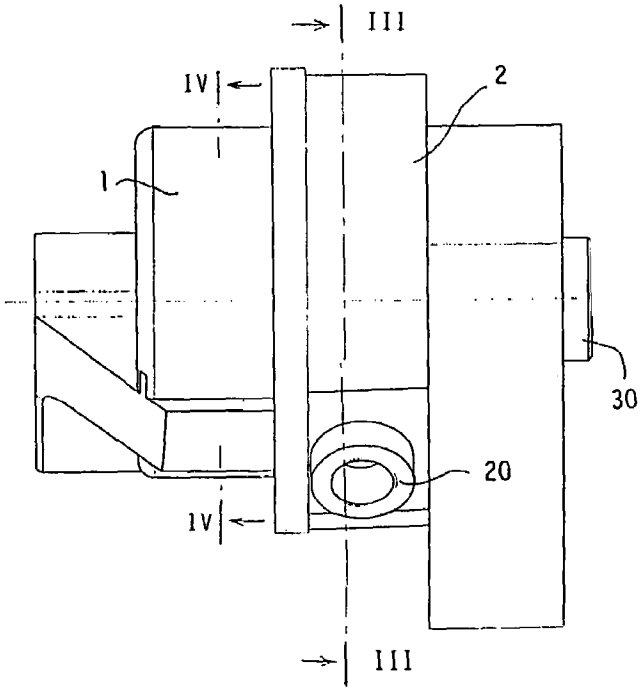
FIG. 2 is an external side view of the fluidic machine according to the invention, assembled with the component parts according to FIG. 1.
Figure 4:
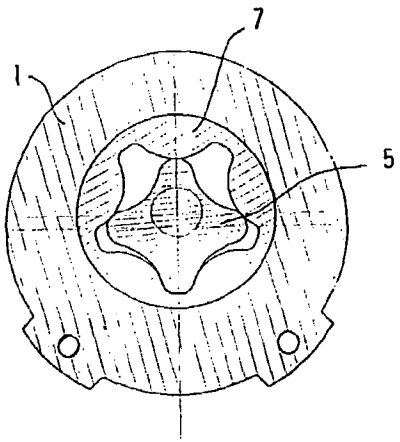
FIG. 4 shows a cross section of the machine, taken along line IV—IV of FIG. 2.

The machine according to the invention is represented in two exemplary embodiments forming hydraulic pumps for the circulation under pressure of the lubricant oil in an automotive engine.

With reference to the first embodiment, represented in FIGS. 1 to 10, the pump includes a fixed body formed by an operative part 1 and a supporting part 2, this latter being intended to be connected to a fixed part of a vehicle, in general the engine, and to receive the operative part 1, connected to and supported by body part 2. The supporting part 2 includes two connections for the circulation circuit of the lubricant oil, namely an intake feed connection 20 and an outlet delivery connection 21. In the supporting part 2 are provided two chambers, an intake chamber 22 connected to the intake feed connection 20, and an outlet chamber 23 connected to the outlet delivery connection 21; these chambers are separated by protrusions.

In the supporting part 2 there is rotatably mounted a transmission member 3 which extends outwards with a clutch pivot 30 for a member intended to actuate the pump. A seal ring 4 establishes a hermetic closure towards the exterior. The transmission member 3 rotates in the supporting part 2 with a relative hydraulic seal with respect to the protrusions separating the chambers 22 and 23. Moreover, the transmission member 3 has conformations 31 suitable for performing a distribution function among the variable spaces of the pump, described later on, and the chambers 22 and 23 connected to the intake feed connection 20 and to the outlet delivery connection 21, respectively.

An internal orbital member 5, which in this embodiment has the shape of a prismatic body forming four external gear teeth, is slidably inserted within an axial cavity 32 of the transmission member 3, and this cavity 32 is shaped in a manner corresponding to the internal orbital member in order to establish both a rotational solidarity and a relative hydraulic seal between the transmission member 3 and said internal orbital member 5. This means that the internal outline of the transmission member 3 (namely, the cavity 32) corresponds to the external outline of the internal orbital member 5. Moreover, a compression spring 6 is inserted between the end of a cavity of the internal orbital member 5 and the end of the cavity 32 of the transmission member 3, and this spring aims to push outwards the internal orbital member 5.

The internal orbital member 5 is engaged in an external orbital member 7, which is mounted in the operative part 1 of the pump body, and is rotatable around an axis which does not coincide with the rotational axis of the transmission member 3. The external orbital member 7 has inner gear teeth, in this case comprising five teeth, which mesh, with relative hydraulic seal, with the external gear teeth, in this case comprising four teeth, of the internal orbital member 5. Between the gear teeth of the two orbital members 5 and 7 are defined some spaces, whose volume varies during the rotation. The cooperation between the two orbital members 5 and 7, with the aid of the distribution conformations 31 of the transmission member 3, which operate among said variable volume spaces and the chambers 22 and 23 of the supporting body part 2, embodies, in a way per se known, a gear pump.

In the cavity delimited by the internal gear teeth of the external orbital member 7 is engaged, axially slidable with relative hydraulic seal, a piston 8, whose external outline corresponds to the internal outline of the external orbital member 7. Piston 8 extends with a guide tang 80 in a bore of the operative body part 1 of the pump. This bore is closed towards the exterior by a plug 11, and the space 10 comprised between this plug 11 and the tang 80, through passages 12 and 24 bored in the body part 1 and in the body part 2, respectively, communicates with the intake feed connection 20, whereby the axial displacements of tang 80 with piston 8 are allowed.

At the end of the cavity in the body part 1, wherein the external orbital member 7 is housed, there is hollowed a chamber 13 which, through passages 14 and 25 bored in the body part 1 and in the body part 2, respectively, communicates with the delivery outlet connection 21. Therefore, in chamber 13 dominates the delivery pressure of the pump, and this pressure acts on piston 8 and aims to push the same in the direction going towards inside the external orbital member 7. On its turn, the internal orbital member 5 is pushed by spring 6 in the direction opposite the direction now stated, whereby it always remains resting against piston 8.

Figure 5:
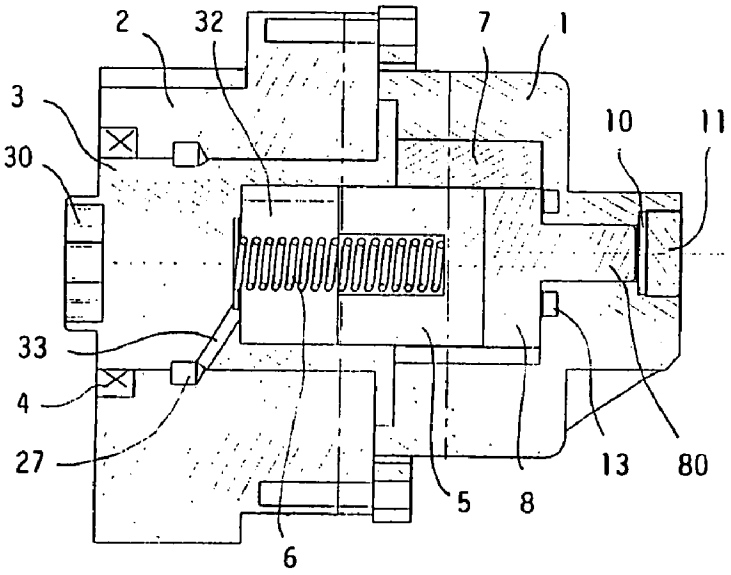
FIG. 5 shows a cross section of the machine, taken along line V—V of FIG. 2, the machine being in the condition of low pressure.
Figure 6:
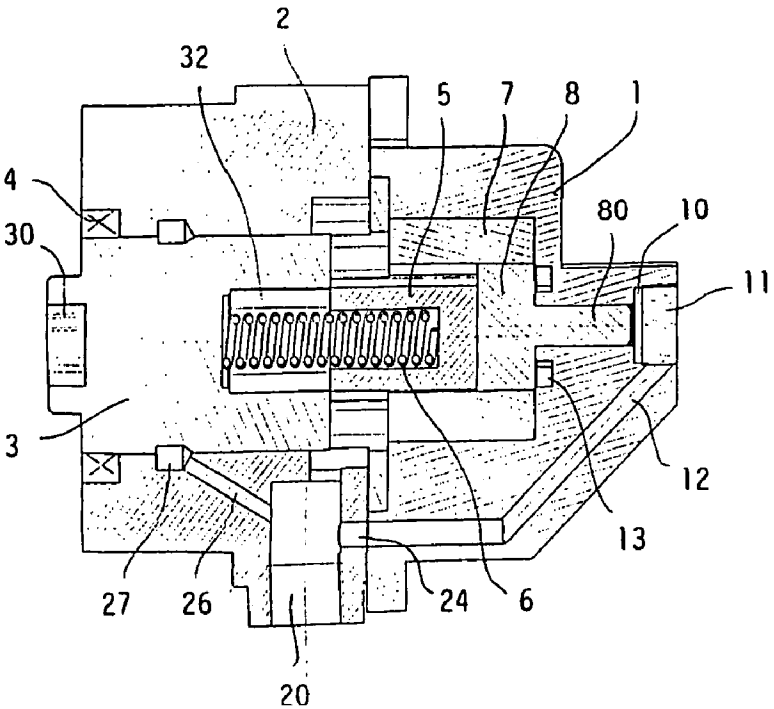
FIG. 6 shows a cross section of the machine, taken along line VI—VI of FIG. 3, the machine being in the condition of low pressure.
Figure 7:
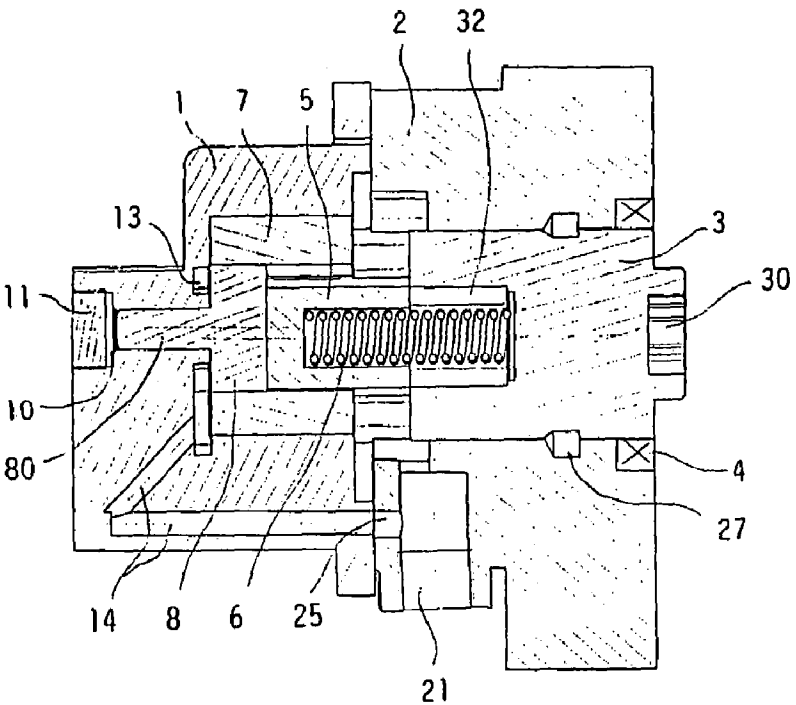
FIG. 7 shows a cross section of the machine, taken along line VII—VII of FIG. 2, the machine being in the condition of low pressure.
Figure 11:
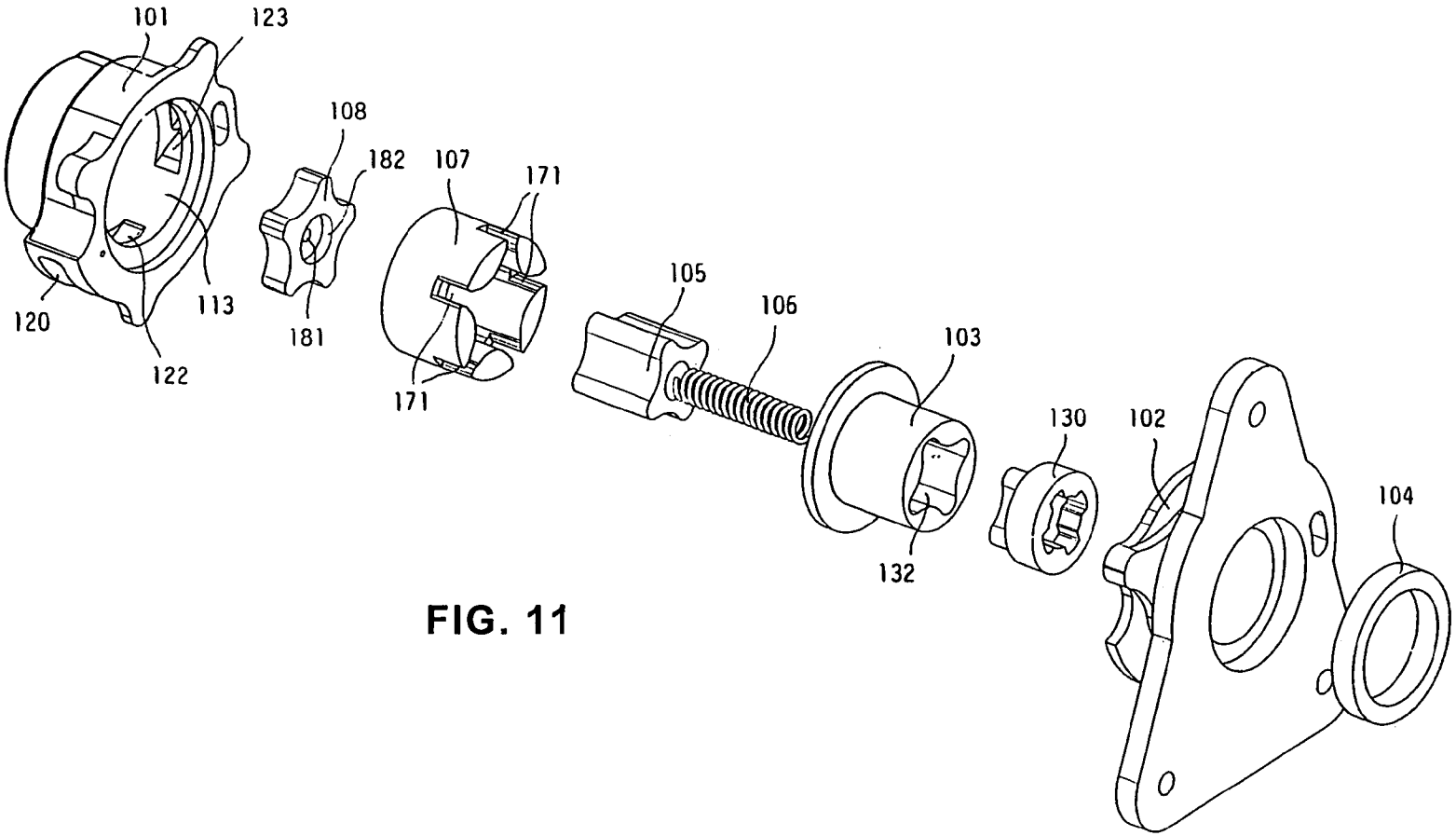
FIG. 11 illustrates the component parts of the fluidic machine in an exploded view in perspective representing the second embodiment described.
Figure 12:
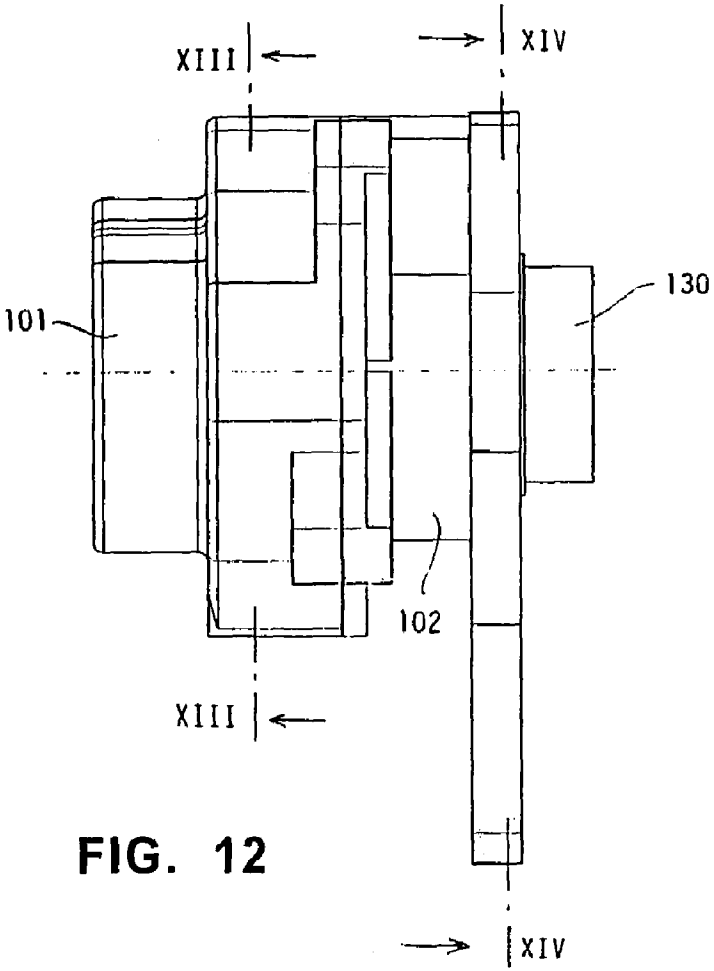
FIG. 12 is an external side view of the fluidic machine according to the invention, assembled with the component parts according to FIG. 11.
Figure 13:
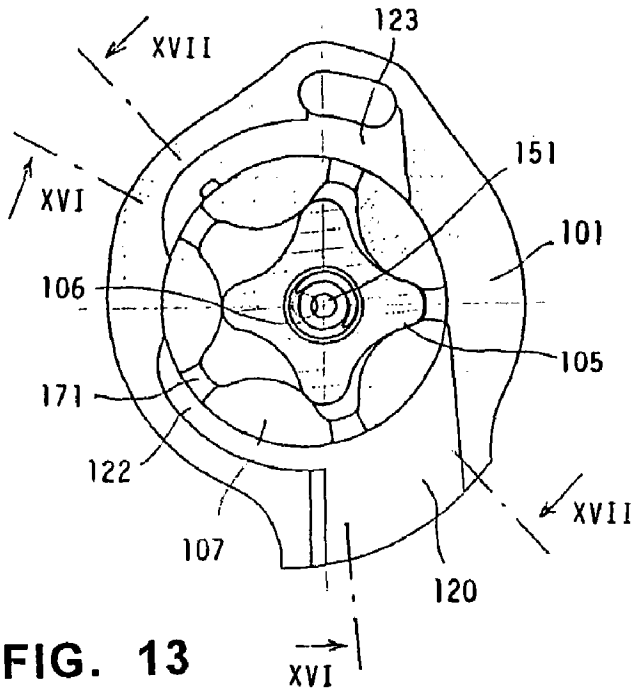
FIG. 13 shows a cross section of the machine, taken along line XIII—XIII of FIG. 12.
Figure 15:
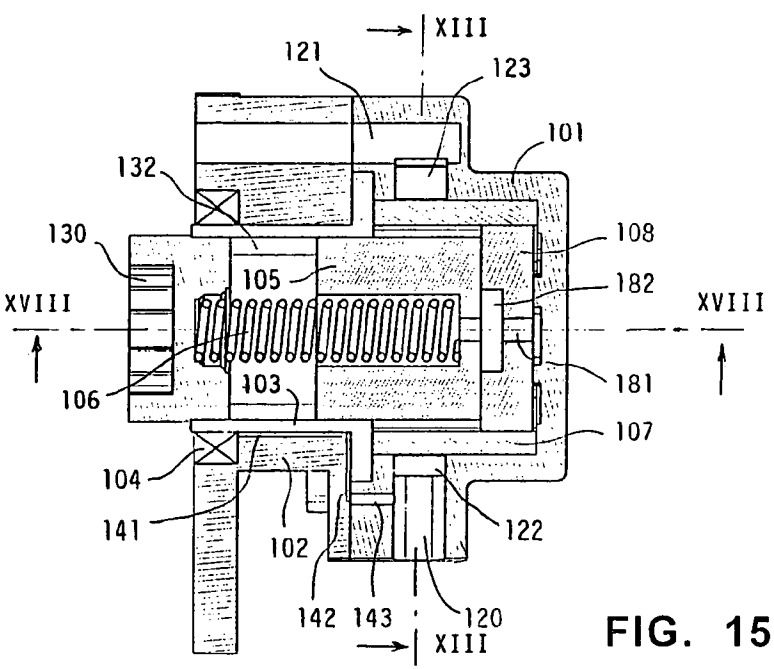
FIG. 15 shows a longitudinal section of the machine, taken along line XV—XV of FIG. 12, the machine being in the condition of low pressure.
Figure 14:
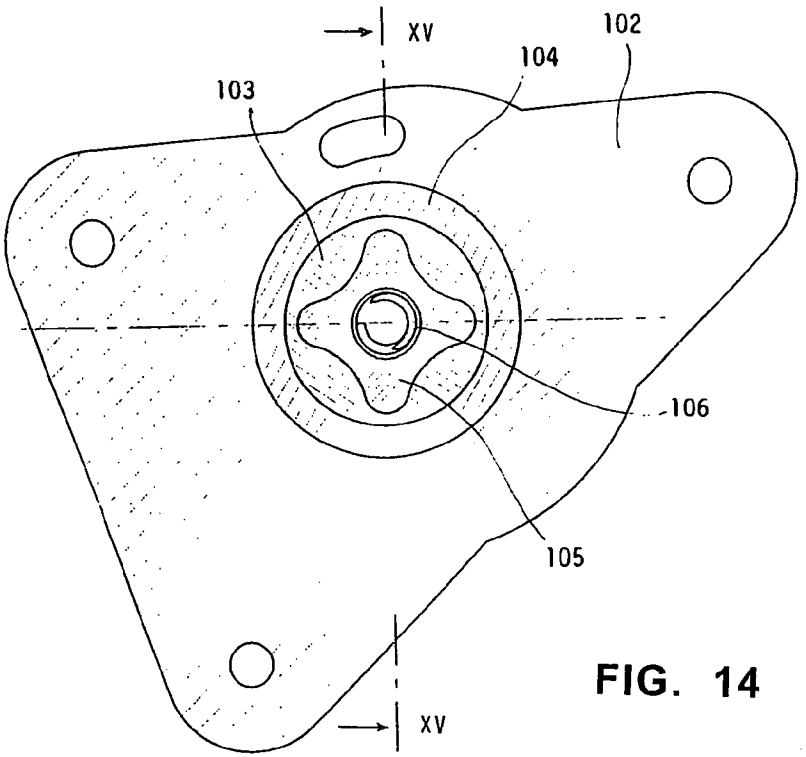
FIG. 14 shows a cross section of the machine, taken along line XIV—XIV of FIG. 12.
Figure 17:
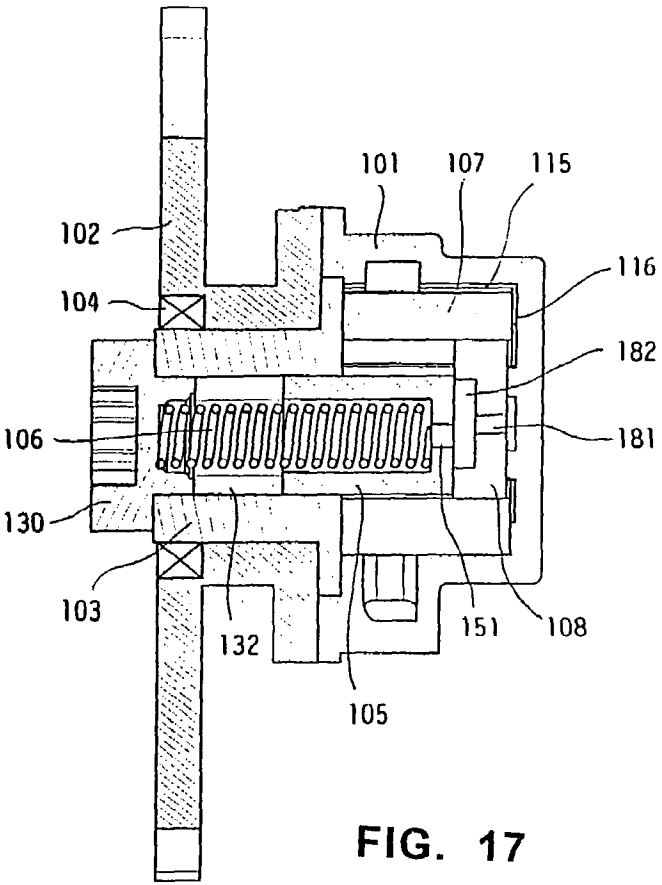
FIG. 17 shows a longitudinal section of the machine, taken along line XVII—XVII of FIG. 12, the machine being in the condition of low pressure.
Figure 16:
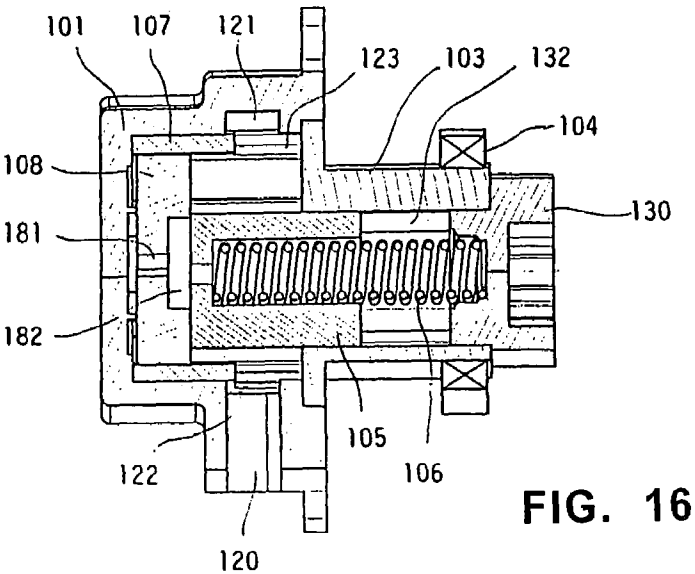
FIG. 16 shows a longitudinal section of the machine, taken along line XVI—XVI of FIG. 13, the machine being in the condition of low pressure.
Figure 19:
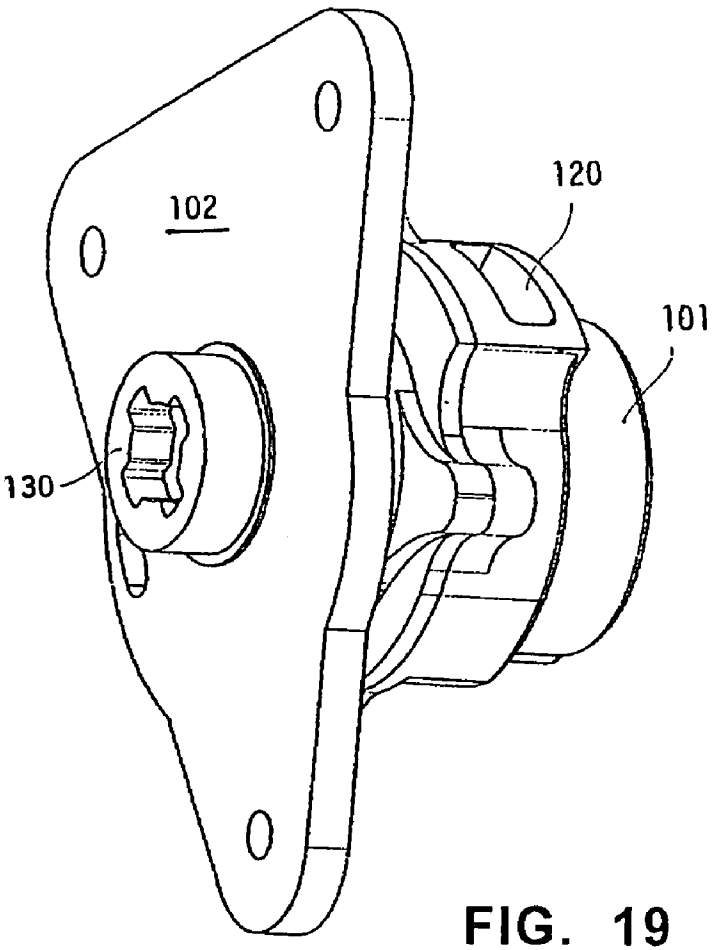
FIG. 19 is a view in perspective of the second embodiment of the invention.
Figure 18:
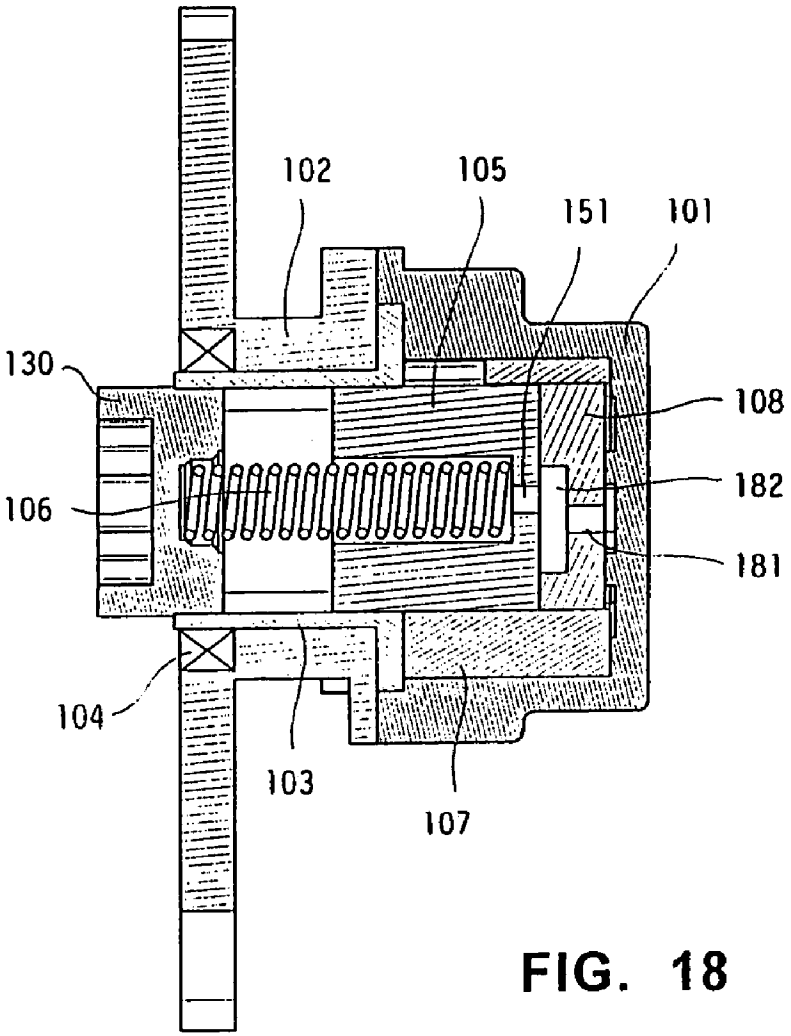
FIG. 18 shows a longitudinal section of the machine, taken along line XVIII—XVIII of FIG. 12, the machine being in the condition of low pressure.

Until the delivery pressure, which acts on the exposed surface of piston 8, generates a force lower than the force exerted by spring 6, the internal orbital member 5 remains engaged within the external orbital member 7 for the maximum possible extension, namely, along a length equal to the difference between the axial extensions of the external orbital member 7 and of the piston 8, respectively (FIGS. 5 to 7). Thus, a swept volume of the pump is generated, that is the greatest allowed by the pump geometry. Until this condition is verified, the pump according to the invention behaves at all as a usual gear pump having the same swept volume.

Figure 8:
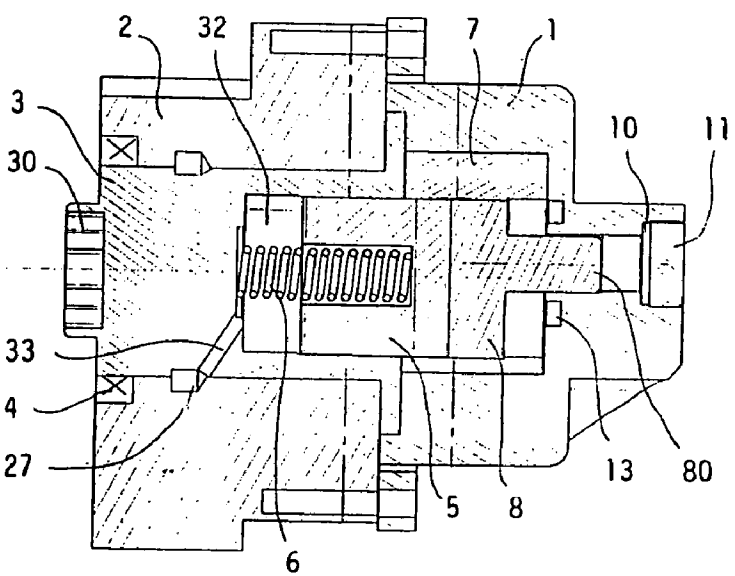
FIGS. 8, 9 and 10 are views similar to those of the foregoing FIGS. 5, 6 and 7, but show the machine in the condition of high pressure.
Figure 9:
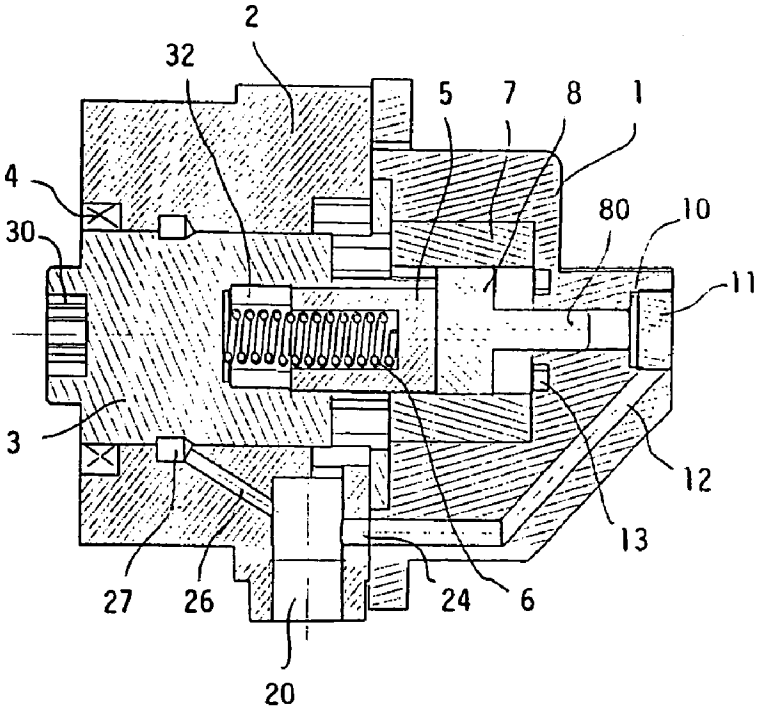
Figure 10:
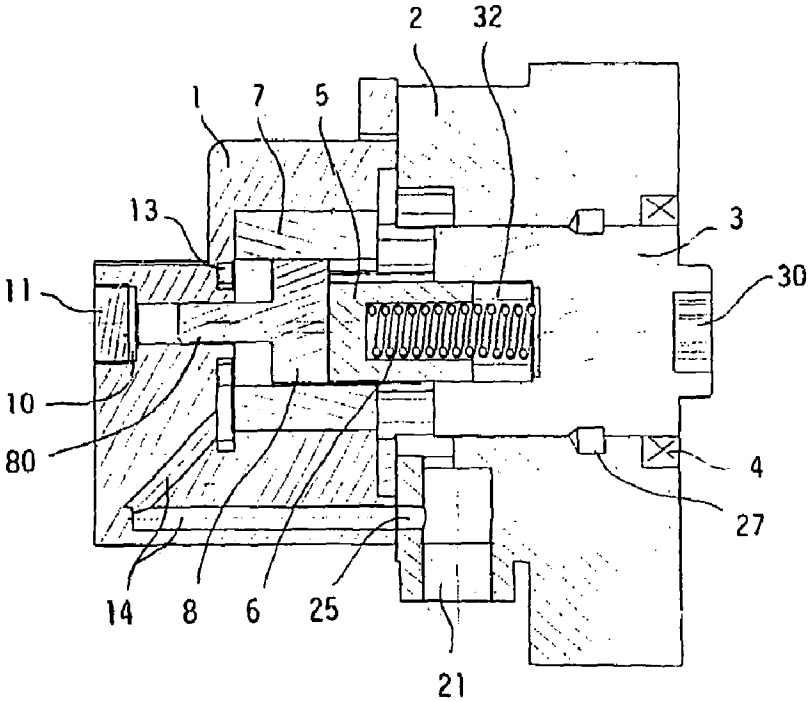

When, increasing the rotational speed applied to the pump, the delivery rate and the delivery pressure at the outlet increase, at a certain moment this pressure, by acting on the exposed surface of piston 8, generates a force larger than the force applied to the internal orbital member 5 by spring 6. Beginning from this moment, piston 8 penetrates into the external orbital member 7 by repelling the internal orbital member 5, which enters in part in the transmission member 3 (FIGS. 8 to 10). Therefrom it ensues a reduction of the swept volume of the pump and, therefore, a reduction of its delivery rate and of the delivery pressure. A balance is thus found, which depends on the elastic characteristics of the compression spring 6 and on the surface of piston 8 which is exposed to the delivery pressure.

As it may be understood from the foregoing, the portion of both orbital members, which is active in the pumping operation and defines the swept volume of the pump, is only the mutually engaging portion thereof and this portion is delimited with relative hydraulic seal, for the external orbital member 7, by piston 8 which penetrates therein and whose external outlet corresponds to the internal outline of the external orbital member 7, and for the internal orbital member 5, by the transmission member 3 whose internal outline corresponds (with the exception of the openings 31 which determinate the distribution function) to the external outline of the internal orbital member 5 which penetrates in the transmission member 3. This swept volume may be varied within broad limits and, therefore, within as much broad limits may be varied the delivery rate of the pump.

Therefore, thanks to the characteristics of the invention, by suitably determining the elastic characteristics of spring 6 and the surface of piston 8 that is exposed to the delivery pressure, it is possible to provide a desired course of the pump performance as a function of the produced delivery pressure, and therefore of the speed at which the pump is operated. It is clear that in a way at all similar it is possible to provide a desired course of the performance of a hydraulic motor as a function of the feed pressure imposed to it.

Because among the moving parts of the pump it is not possible to provide an hermetic hydraulic seal, but only a relative (namely, partial) hydraulic seal, some leakages of oil take place. In order to recover these leakages, the passages 33 and 26 and an annular chamber 27 are provided in the transmission member 3 and in the body part 2, respectively, communicating with the intake connection 20.

The structure of the second embodiment, represented in FIGS. 11 to 19, differs from the structure of the first embodiment in practical features intended to render more easy the manufacture and the assemblage of the machine. In this embodiment, the pump is based on the same conception of the first embodiment and operates in a manner at all equivalent, whereby it is not needed to describe in detail its structure and operation; of this second embodiment are therefore described only the differences with respect to the first embodiment. The component parts of the second embodiment which correspond to component parts of the first embodiment are designated by the same numbers of reference, increased by 100.

A first noticeable difference resides in that, in the second embodiment, the member acting as a distributor among the variable volume spaces and the chambers of the fixed body is the external orbital member 107, instead of the transmission member 3 of the first embodiment. To this aim, the external orbital member 107 has special conformations 171. As a consequence, the intake chamber 122 and the delivery chamber 123, as well as, of course, the corresponding intake feed connection 120 and delivery outlet connection 121 are located in the operative body party 101 rather than in the supporting body part 102.

The structure of piston 108 is simplified, and it is no more provided with a guide tang; as a consequence, also the corformation of the operative body part 101 is correspondingly simplified, and the chamber 113 receives the required pressure through a bore 181 made in piston 108, a chamber 182 also hollowed in piston 108, and a bore 151 made in the internal orbital member 105, this latter bore communicating with the axial cavity 132 of the transmission member 103. The pressure present in the delivery chamber 123 arrives to the end of the axial cavity 132 through a longitudinal passage 115 and a radial passage 116 (FIG. 17) hollowed in the operative body part 101. Chamber 182 of piston 108, in addition to serve to the cited connection, also has the function of reducing the contact surface between the piston 108 and the internal orbital member 105.

The drainage of the oil leakage towards the seal ring 104 takes place through a longitudinal passage 141, a radial passage 142 and a longitudinal bore 143, all made in the operative body part 101 of the pump. The longitudinal bore 143 opens in the low pressure connection 120.

The transmission member 103 is embodied separately from the clutch pivot 130 in order to facilitate their manufacture.

As it may be easily remarked, the second embodiment offers noticeable simplifications in its structure with respect to the first embodiment, though attaining an identical operation.

It is to be understood that the invention is not limited to the embodiments described and illustrated as examples. Several possible changes have been described, and various others are within the capacity of a skilled person; for example, the functions of different members may be respectively exchanged, and thus one could foresee that the possibility of axial displacement against the action of pushing means be attributed to the external orbital member rather than to the internal orbital member. The pushing means, which in the more simple embodiment consist of one or more compression springs, could be replaced by other elastic members or even by hydraulic or pneumatic pushing means, which may be controlled in various manners. It is also evident that the fluidic machine, described as a hydraulic pump, could be used as a hydraulic motor by feeding to the connection 21 or 121 a feed fluid under pressure, which is then discharged at a lower pressure from the connection 20 or 120. The characteristics of such a motor, and particularly its swept volume and therefore the torque and the angular speed delivered through the transmission member 3, depend on the feed pressure. Finally, it is to be understood that, although the foreseen application of the invention prevailing concerns hydraulic machines, the invention may also find application in pneumatic machines, particularly by having recourse to autolubricant materials or to the so called "damp lubrication".

The cited changes and others, and any replacement by technically equivalent means, may be introduced in what has been described and illustrated, without departing from the spirit of the invention as defined by the appended Claims.

The invention claimed is:

1. A fluidic machine comprising: a fixed body (1,2;101, 102); an external orbital member (7;107) installed in said fixed body (1;101), supported and guided by said fixed body for rotation around a first rotational axis, said external orbital member (7;107) having internal gear teeth comprising a first teeth number; a transmission member (3;103) installed in said fixed body (2;102), supported and guided by said fixed body for rotation around a second rotational axis not coincident with said first rotational axis; an internal orbital member (5;105) supported by said transmission member (3;103) and solid in rotation therewith, said internal orbital member (5;105) having external gear teeth comprising a second teeth number different from said first teeth number, and said internal orbital member (5;105) extending within said external orbital member (7;107) and having its own external gear teeth meshing, with relative (namely, only partial) fluid seal, with the internal gear teeth of the external orbital member (7;107), thus determining among the gear teeth of the two orbital members spaces whose volume is variable during the rotation; said fixed body (1;102) having two chambers (22,23;122,123), connected with a low pressure connection (20;120) and to a high pressure connection (21;121), respectively; and one of said internal and external orbital members being so shaped as to act as a distributor among said variable volume spaces and said chambers of the fixed body;

characterized in that one of said internal and external orbital members (5,7;105,107) is mounted axially displaceable, with relative fluid seal, in a component part (3,1;103,101) by which it is supported; that the machine comprises a push member (6;106) acting against said axially displaceable orbital member (5,7; 105,107) for pushing the same in the direction producing a more extended engagement with the other orbital member (7,5;107,105); and that the machine comprises a piston (8;108), which is mounted displaceable, with relative fluid seal, within the nonaxially displaceable orbital member (7,5;107,105), rests against said axially displaceable orbital member (5,7;105,107), and is subjected, on the side opposite the axially displaceable orbital member, to the pressure of the high pressure connection (21;121); whereby said axially displaceable orbital member is pushed by the pressure of the high pressure connection (21;121) to withdraw, against the action of said push member, within the part supporting the same, this latter along with said piston delimiting the operatively active portion of the two mutually meshing orbital members (5,7; 105,107), namely, the swept volume of the fluidic machine, and characterized in that said orbital member intended to act as a distributor is said transmission member (3).

2. A fluidic machine according to claim 1, characterized in that the external orbital member (7;107) is mounted in a fixed axial position, and the internal orbital member (5;105)

is mounted axially displaceable, with relative fluid seal, within the transmission member (3;103), this latter having an internal outline corresponding to the external outline of the internal orbital member (5;105), which penetrates in part therein with relative fluid seal.

3. A fluidic machine according to claim 2, characterized in that said push member (6;106) comprise a compression spring (6;106) acting between a surface of said internal orbital member (5;105) and an end surface of a cavity (32;132) of the transmission member (3;103), in which cavity is mounted the internal orbital member (5;105).

4. A fluidic machine according to claim 1, characterized in that the external orbital member (7;107) has internal gear teeth comprising five teeth, and the internal orbital member (5:105) has external gear teeth comprising four teeth.

5. A fluidic machine according to claim 1, characterized in that the machine body (1,2;101,102) is formed of two mutually connected parts, a first part forming an operative body (1;101) which contains the external orbital member (7;107), and a second part forming a supporting body (2;102) which contains the transmission member (3;103); one of said body parts being provided with the low pressure connection (20;120) and the high pressure connection (21; 121).

6. A fluidic machine according to claim 5, characterized in that the low pressure and high pressure connections (20,21) are located in the body part forming a supporting body (2).

7. A fluidic machine according to claim 5, characterized in that the low pressure and high pressure connections (120, 121) are located in the body part forming an operative body (101).

8. A fluidic machine according to claim 1, characterized in that it forms a hydraulic machine.

9. A fluidic machine according to claim 8, characterized in that it forms a pump intended to maintain under pressure the lubricant oil of an engine, especially an automotive engine.

10. A fluidic machine according to claim 1, characterized in that it forms a pneumatic machine.

11. A fluidic machine comprising: a fixed body (1,2;101, 102); an external orbital member (7;107) installed in said fixed body (1;101), supported and guided by said fixed body for rotation around a first rotational axis, said external orbital member (7;107) having internal gear teeth comprising a first teeth number; a transmission member (3;103) installed in said fixed body (2;102), supported and guided by said fixed body for rotation around a second rotational axis not coincident with said first rotational axis; an internal orbital member (5;105) supported by said transmission member (3;103) and solid in rotation therewith, said internal orbital member (5;105) having external gear teeth comprising a second teeth number different from said first teeth number, and said internal orbital member (5;105) extending within said external orbital member (7;107) and having its own external gear teeth meshing, with relative (namely, only partial) fluid seal, with the internal gear teeth of the external orbital member (7;107), thus determining among the gear teeth of the two orbital members spaces whose volume is variable during the rotation; said fixed body (1;102) having two chambers (22,23;122,123), connected with a low pressure connection (20;120) and to a high pressure connection (21;121), respectively; and one of said internal and external orbital members being so shaped as to act as a distributor among said variable volume spaces and said chambers of the fixed body;

characterized in that one of said internal and external orbital members (5,7;105,107) is mounted axially displaceable, with relative fluid seal, in a component part (3,1;103,101) by which it is supported; that the machine comprises a push member (6;106) acting against said axially displaceable orbital member (5,7; 105,107) for pushing the same in the direction producing a more extended engagement with the other orbital member (7,5;107,105); and that the machine comprises a piston (8;108), which is mounted displaceable, with relative fluid seal, within the non-axially displaceable orbital member (7,5;107,105), rests against said axially displaceable orbital member (5,7;105,107), and is subjected, on the side opposite the axially displaceable orbital member, to the pressure of the high pressure connection (21;121); whereby said axially displaceable orbital member is pushed by the pressure of the high pressure connection (21;121) to withdraw, against the action of said push member, within the part supporting the same, this latter along with said piston delimiting the operatively active portion of the two mutually meshing orbital members (5,7; 105,107), namely, the swept volume of the fluidic machine, characterized in that the external orbital member (7;107) is mounted in a fixed axial position, and the internal orbital member (5;105) is mounted axially displaceable, with relative fluid seal, within the transmission member (3;103), this latter having an internal outline corresponding to the external outline of the internal orbital member (5;105), which penetrates in part therein with relative fluid seal, and characterized in that the internal orbital member is mounted in a fixed axial position, and the external orbital member is mounted axially displaceable, with relative fluid seal, within said machine body.

12. A fluidic machine according to claim 11, characterized in that said push member comprise a compression spring acting between a surface of said external orbital member and an end surface of a cavity of the machine body, in which cavity is mounted the external orbital member.

13. A fluidic machine according to claim 11, characterized in that said orbital member intended to act as a distributor is said external orbital member (107).

* * * * *